US008577246B2

(12) United States Patent
Sakurai et al.

(10) Patent No.: US 8,577,246 B2
(45) Date of Patent: Nov. 5, 2013

(54) DEVELOPER CONTAINING DEVICE AND IMAGE FORMING APPARATUS

(75) Inventors: Hideto Sakurai, Setagaya-ku (JP); Syuichi Katogi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 138 days.

(21) Appl. No.: 13/151,549

(22) Filed: Jun. 2, 2011

(65) Prior Publication Data

US 2011/0305477 A1 Dec. 15, 2011

(30) Foreign Application Priority Data

Jun. 11, 2010 (JP) ..... 2010-134218

(51) Int. Cl.
*G03G 15/08* (2006.01)

(52) U.S. Cl.
USPC ..... 399/92; 399/103

(58) Field of Classification Search
USPC ..... 399/92, 102, 103
See application file for complete search history.

(56) References Cited

U.S. PATENT DOCUMENTS

| | | | | |
|---|---|---|---|---|
| 5,946,530 | A * | 8/1999 | Tsuji et al. | 399/103 |
| 2005/0175376 | A1* | 8/2005 | Sekiguchi | 399/258 |
| 2009/0028599 | A1* | 1/2009 | Jun | 399/103 |

FOREIGN PATENT DOCUMENTS

| | | | |
|---|---|---|---|
| JP | 04-118674 | A | 4/1992 |
| JP | 4118674 | A * | 4/1992 |
| JP | 6-130791 | A | 5/1994 |
| JP | 2000-19919 | A | 1/2000 |
| JP | 2003-57927 | A | 2/2003 |
| JP | 2005-140968 | A | 6/2005 |
| JP | 2007-058023 | A | 3/2007 |
| JP | 2007058023 | A * | 3/2007 |
| JP | 2007-171865 | A | 7/2007 |
| JP | 2007-292124 | A | 11/2007 |
| JP | 2007292124 | A * | 11/2007 |

OTHER PUBLICATIONS

Office Action (Notice of Grounds of Rejection) dated Apr. 17, 2012, issued by the Japanese Patent Office in the corresponding Japanese Patent Application No. 2010-134218 and an English Translation of Office Action. (4 pages).

Office Action (Decision to Grant Patent) dated Jul. 10, 2012, issued in corresponding Japanese Patent Application No. 2010-134218, and an English Translation thereof. (6 pages).

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

A developer containing device for containing a developer includes a partition arranged between an outer space and an inner space for containing the developer, a bearing arranged on the partition, a rotation shaft carried by the bearing and extending from the outer space to the inner space, a sealing member arranged on the inner space side, having one end side fixed to the partition and the other end side being in contact with a surface of the rotation shaft, and thereby isolating the bearing from the inner space, a communication groove arranged at the surface of the rotation shaft, and connecting the outer space to a closed space isolated from the inner space by the sealing member, and a communication passage arranged on the partition for connecting the outer space to the closed space.

14 Claims, 10 Drawing Sheets

DEVELOPER CONTAINING DEVICE AND IMAGE FORMING APPARATUS

This application is based on Japanese Patent Application No. 2010-134218 filed with the Japan Patent Office on Jun. 11, 2010, the entire content of which is hereby incorporated by reference.

BACKGROUND OF THE INVENTION

1. Field of the Invention

The present invention relates to a developer containing device used in an image forming step for forming images by an electrophotographic method as well as an image forming apparatus having the developer containing device. The image forming apparatuses may include recording devices and display devices such as monochrome or color copiers, facsimiles, and others.

2. Description of the Related Art

The electrophotographic image forming apparatus includes a charging device for uniformly charging an image carrier corresponding to an image forming process, an image exposing device for forming an electrostatic latent image from electric charges on a surface of the image carrier, a developing device for visualizing the electrostatic latent image with a developer, a transferring device for electrically and mechanically transferring the visualized image on the image carrier onto a recording medium (paper or the like), a cleaning device for removing the developer (toner or the like) that remains on the image carrier after the transferring operation by the transfer device, and a fixing device for permanently fixing the visualized developer on the recording member by heat and pressure.

In the image forming apparatus having the above structure, process units are formed of the image carrier, the charging device, the exposing device, the developing device, the transferring device and the cleaning device. In general, the image forming apparatus employs a process unit in which the image carrier, the charging device, the cleaning device and the transferring device are integrated, although certain types of the image forming apparatuses do not employ such units.

In recent years, according to wide spreading of such apparatuses complying with the above processes and particularly the image forming apparatuses of which major features are full-color output, it has been required to reduce the sizes of the image forming apparatuses and to increase a print speed, and further to achieve a long life, high reliability, high image quality and low cost of the image forming apparatus.

For example, the developing device is provided with a developer containing device containing a developer. For preventing external leakage of the developer, the developer containing device has a sealing member (shaft sealing member or the like) arranged on a portion (e.g., a space between a rotation shaft for transporting developer and a bearing unit for the shaft) where a space is formed.

In the image forming apparatus, the transporting speed of the recording member has been increased for complying with a request to increase the print speed, and this generates a large amount of heat in the bearing unit. The developer is melted by heat generated in the bearing unit so that situations such as subsequent fixing of such developer to the sealing member will cause insufficient sealing by the sealing member, and fixing of the developer to the bearing unit will cause problems such as a failure in rotation of the rotation shaft. Japanese Laid-Open Patent Publication Nos. 2005-140968, 2000-019919 and 2003-057927 (Documents 1, 2 and 3, respectively) have pointed out the problems relating to defective image formation on the recording medium due to such failures, and have made various proposals for overcoming such problems.

The Document 1 has disclosed a developing device and an image forming apparatus. In this developing device, a rotation shaft for developer transportation has a hollow structure, and a fluid is supplied into the rotation shaft for cooling a bearing unit and thereby suppressing generation of heat in the bearing unit.

However, this structure additionally requires a pump for supplying the fluid into the developer transportation shaft as well as a heat exchanger for the fluid. This may increase sizes and a cost of the developing device. Further, the heat generated from the bearing unit is transferred to the fluid through the rotation shaft, and therefore may heat the developer to melt it before the heat is released to the fluid.

The Document 2 has disclosed a cleaning device and an image forming apparatus provided with the cleaning device. This device employs a heat-radiation shaft formed by extending a rotation shaft as well as heat-radiation fins arranged on the heat-radiation shaft. However, addition of the heat-radiation shaft and the heat-radiation fins may increase sizes of the apparatus. Further, the heat generated in the bearing unit is transmitted not only to the heat-radiation shaft but also to the rotation shaft (on the containing side of the developer) so that the rotation shaft may heat the developer to melt it.

The Document 3 has disclosed a developing device and a process cartridge provided with the developing device as well as an image forming apparatus. For this device, it has disclosed a structure in which a space having ventilation apertures for heat radiation is arranged at an end of the developing device, and a structure in which an air-flow assistance member is arranged in the above space. However, additional provision of the space having the ventilation apertures may increase sizes of the apparatus.

SUMMARY OF THE INVENTION

The present invention has been made for overcoming the above problems, and provides a developer containing device and an image forming apparatus that can efficiently suppress heat generation in a bearing unit without increasing sizes of the apparatus.

In a developing device based on the invention, a developer containing device for containing a developer includes a partition located between an outer space and an inner space for containing the developer; a bearing arranged on the partition; a rotation shaft carried by the bearing and extending from the outer space into the inner space; a sealing member arranged on the inner space side for isolating the bearing from the inner space by fixing one end side of the sealing member to the partition side and keeping the other end side in contact with a surface of the rotation axis; a communication groove arranged at the surface of the rotation shaft for connecting the outer space to a closed space isolated by the sealing member from the inner space; and a communication passage arranged in the partition for connecting the outer space to the closed space.

The communication groove has a groove form causing an air flow in an axial direction on a surface of the communication groove according to rotation of the rotation shaft.

In another aspect of the invention, the communication groove is inclined with respect to the axial direction of the rotation shaft.

In another aspect of the invention, the communication groove has first and second grooves at the shaft surface opposed to the bearing, the first and second grooves are inclined with respect to the axial direction, and the respective inclination directions of the first and second grooves are symmetrical with respect to line in the axial direction.

In another aspect of the invention, the partition is an outer wall of the developer containing device.

In another aspect of the invention, the rotation shaft is a transportation screw shaft provided with a developer transportation screw of the developer containing device.

An image forming apparatus according to the invention has one of the developer containing devices described above.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Developer containing devices and image forming apparatuses of an embodiment and practical examples according to the invention will be described below with reference to the drawings. In the following description of the embodiment and practical examples, the numbers of items, quantities and the like do not restrict the scope of the invention unless otherwise specified. The same or corresponding parts bear the same reference numbers, and description thereof may not be repeated.

As an example of the image forming apparatus, the following description will be made on an image forming apparatus 1000 employing a general full-color electrophotographic system. However, the invention is not restricted to the full-color electrophotographic system, and may be applied to an image forming apparatus employing a single kind (e.g., black) of image forming unit that can form only monochrome images.

(Image Forming Apparatus 1000)

Referring to FIGS. 1 to 5, description will be made on image forming apparatus 1000 and a developing device 4 according to the embodiment.

Figure 1:
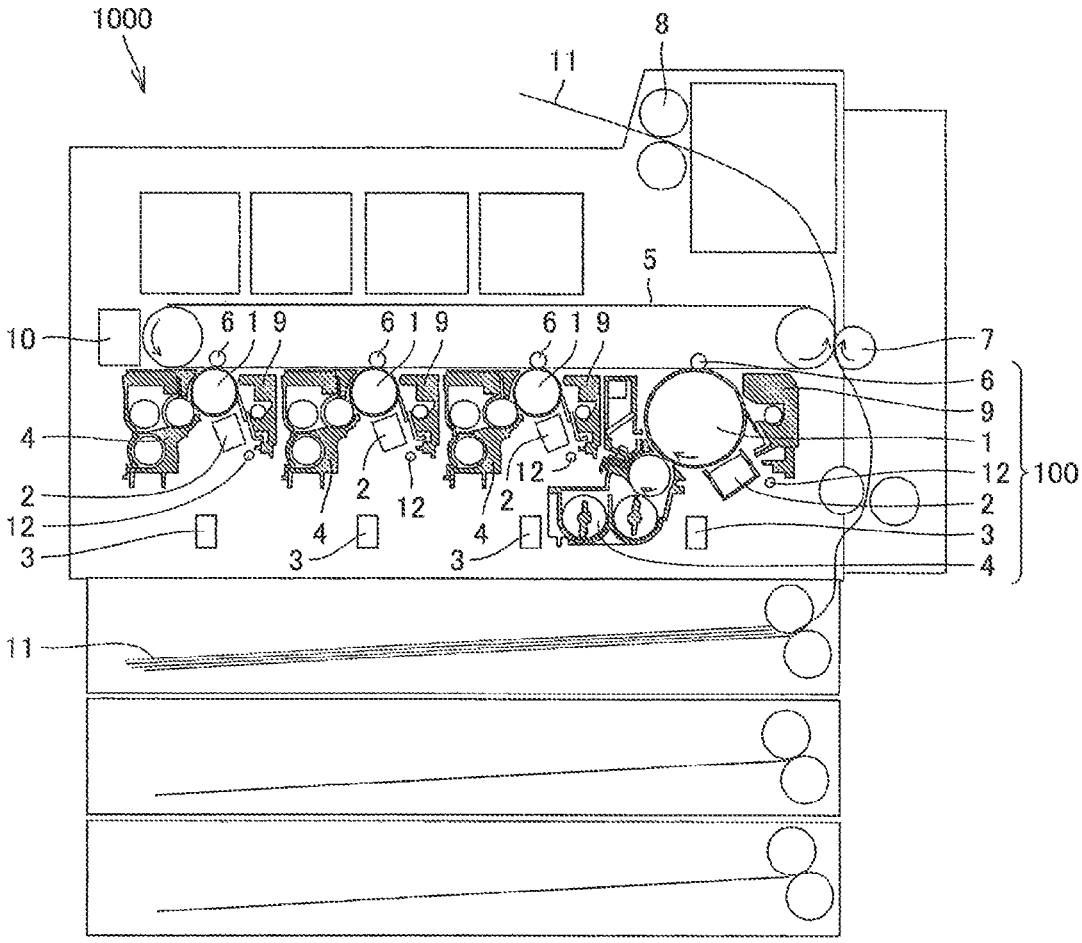
FIG. 1 is a longitudinal section showing an internal structure of an image forming apparatus employing a developer containing device according to the embodiment.

Referring first to FIG. 1, image forming apparatus 1000 according to the embodiment employs a general type of full-color electrophotographic system. Image forming apparatus 1000 includes four kinds of image forming units 100 that correspond to respective colors (yellow, magenta, cyan and black) and are arranged in predetermined positions, respectively.

Each image forming unit 100 has an image carrier 1 that is called a "photoreceptor", a charging device 2 for uniformly charging a surface of image carrier 1 to provide a potential, an image exposing device 3 for emitting light, for forming a predetermined electrostatic latent image, to the charged potential at a desired level attained by charging device 2, developing device 4 for forming a mirror image by attaching, by an electric field or the like, a developer onto a region bearing the electrostatic latent image, a transfer belt 5, a primary transfer device 6, a secondary transfer device 7 and a fixing device 8 as well as a cleaning device 9 and an charge-removing device 12 for electrically or mechanically removing residual powder remaining on image carrier 1 therefrom.

In primary transfer device 6, the electric field and voltage successively move the powder forming a mirror image from image carrier 1 onto transfer belt 5 that is called an "intermediate transfer member". In secondary transfer device 7, the electric field and voltage move the powder from transfer belt 5 onto a recording medium 11 such as a paper sheet. In fixing device 8, the heat and pressure permanently fix the powder moved onto recording medium P to recording medium P.

In some cases, however, primary transfer device 6 does not completely move the powder from transfer belt 5, and a slight amount of powder remains on image carrier 1. In these cases, cleaning device 9 and charge-removing device 12 are used to remove electrically and/or mechanically the residual power from image carrier 1.

In some cases, secondary transfer device 7 does not completely move the powder forming the mirror image from transfer belt 5, and a slight amount of powder remains on transfer belt 5. In these cases, a belt cleaning device 10 electrically and/or mechanically removes the powder.

The developer means powder made of toner or powder containing toner and carrier. Therefore, when one-component developer not containing the carrier is employed, the developer is the power not containing the carrier. When two-component developer containing the toner and the carrier is used, the developer is the power made of the toner or the powder made of the toner and the carrier.

The one- or two-component developer contained in developing device 4, the toner supplied to developing device 4, the toner collected by cleaning device 9, the toner returned from cleaning device 9 to developing device 4 for reuse and others are specific examples of the developer used in image forming apparatus 1000.

(Structure of Developing Device 4)

Figure 2:
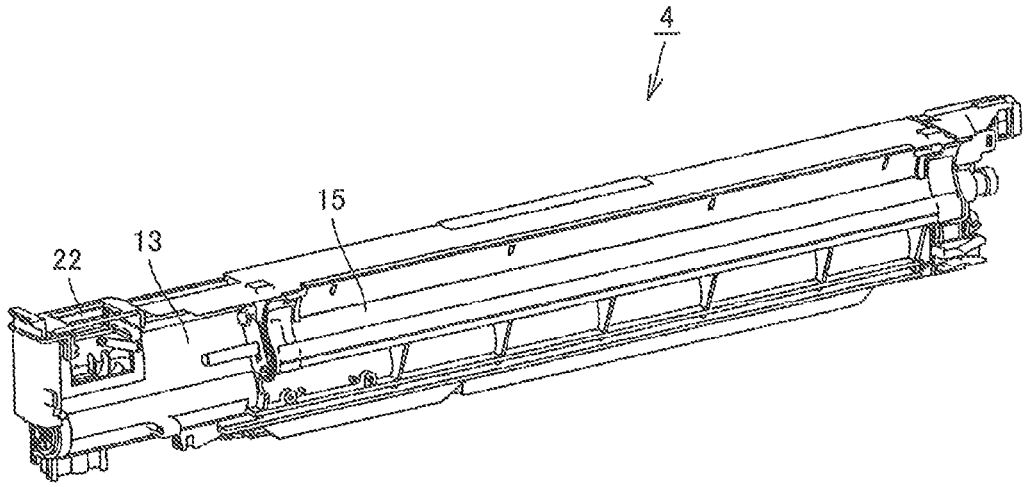
FIG. 2 is a perspective view showing an external structure of a developing device employing the developer containing device according to the embodiment.
Figure 3B:
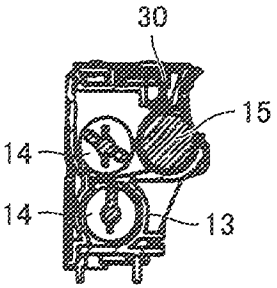
FIG. 3B is a side view showing the internal structure of the developing device employing the developer containing device according to the embodiment.
Figure 3A:
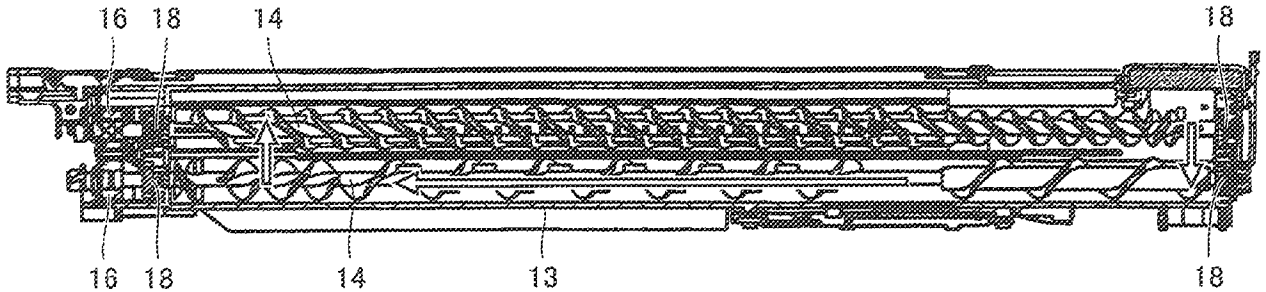
FIG. 3A is a plan showing an internal structure of the developing device employing the developer containing device according to the embodiment.

Referring to FIGS. 2, 3A and 3B, the structure of developing device 4 will be described. Developing device 4 includes a box-like containing unit 13 for containing the developer, transportation screw shafts 14 serving as rotation shafts for transporting and circulating, in a direction indicated by arrow in FIGS. 3A and 3B, the developer contained in containing unit 13, a developing roller 15 for forming the mirror image from the developer on image carrier 1, a restriction plate 30 restricting an amount of the developer on the surface of developing roller 15 to a predetermined amount, a plurality of gears 16 for transmitting a rotational drive power from an electric motor or the like arranged outside to transportation screw shafts 14 and developing roller 15, and a sealing member 18 for preventing external leakage of the developer from containing unit 13.

Two transportation screw shafts 14 are parallel to each other. Each transportation screw shaft 14 is provided on its outer surface with a screw 14S of which developer transporting direction is opposite to that of screw 14S on the other transportation screw shaft 14. Each transportation screw shaft 14 and developing roller 15 are coupled together via gears 16 for rotation in an interlocked fashion.

(Developer Containing Device 4A)

Containing unit 13, transportation screw shaft 14 and sealing member 18 in developing device 4 will be referred to as a "developer containing device 4A", of which specific structure will be described with reference to FIGS. 4 to 9. Also, one of two transportation screw shafts 14 will be described below.

Figure 4:
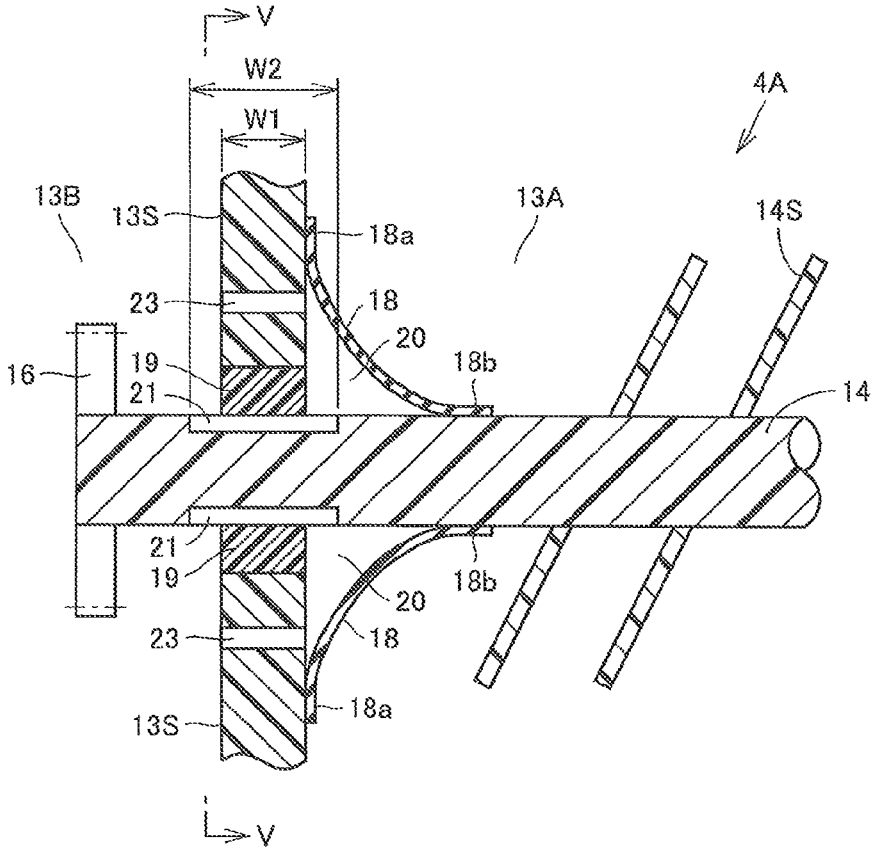
FIG. 4 is a fragmentary section showing, on an enlarged scale, a region containing a sealing member arranged on a partition in the embodiment.

Referring to FIG. 4, containing unit 13 of the box-like form has a partition 13S located between an outer space 13B and an inner space 13A containing the developer. Partition 13S is provided with a bearing 19. Bearing 19 carries one end side or portion of transportation screw shaft 14 that is the rotation shaft extending from outer space 13B into inner space 13A. The one end portion of transportation screw shaft 14 protrudes through partition 13S into outer space 13B.

Gear 16 is arranged on one end of transportation screw shaft 14. Gear 16 is located in outer space 13B, and screw 14S is located in inner space 13A. Containing unit 13, transportation screw shaft 14 including screw 14S, bearing 19 and gear 16 are molded parts of resin or the like.

In inner space 13A, cylindrical sealing member 18 having a conical outer surface is arranged to cover one end portion of transportation screw shaft 14, Sealing member 18 is made of rubber, elastomer resin or the like. One end side 18*a* of sealing member 18 having a larger diameter is fixed to partition 13S, and the other end side 18*b* of a smaller diameter is pressed against the surface of transportation screw shaft 14. This isolates bearing 19 from inner space 13A to form a shaft sealing structure that defines a closed space 20 in inner space 13A. This shaft sealing structure suppresses leakage of the developer from inner space 13A to outer space 13B.

On the other end side (not shown) of transportation screw shaft 14, gear 16 is not arranged, but a similar shaft sealing structure is employed. Sealing member 18 is arranged in inner space 13A so that bearing 19 is isolated from inner space 13A, and closed space 20 is formed in inner space 13A. On the other end side of transportation screw shaft 14, partition 13S forms an outer wall of containing unit 13, i.e.., an outer wall of developer containing device 4A.

Figure 5:
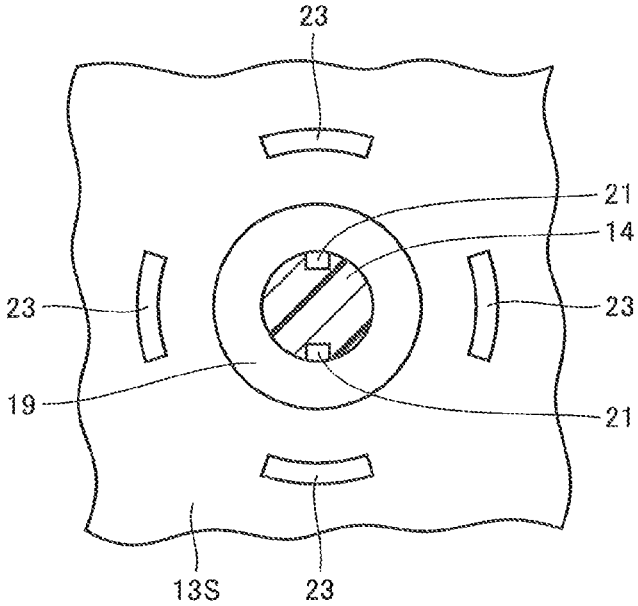
FIG. 5 is a section taken along line V-V in FIG. 4.

Referring to FIGS. 4 and 5, a portion of transportation screw shaft 14 carried by bearing 19 is provided at its surface with communication grooves 21 for connecting outer space 13B to closed space 20. Since communication grooves 21 connect outer space 13B to closed space 20, a length (W2) of communication groove 21 on a section containing the axis is longer than a width (W1) of partition 13S, and such a state is attained that communication groove 21 contains partition 13S.

In this embodiment, transportation screw shaft 14 is provided at two diametrically opposite portions of its surface with communication grooves 21, respectively. A specific form of communication groove 21 will be described later. The number of communication grooves 21 is not restricted to two, and communication groove(s) 21 may be arranged in only one position or three or more positions.

Partition 13S is provided with communication passages 23 connecting outer space 13B to closed space 20. In this embodiment, transportation screw shaft 14 is provided with communication passages 23 located at four positions circumferentially spaced by 90 degrees from each other, respectively. Each communication passage 23 has an arc-shaped form. The number of communication passages 23 is not restricted to four, and communication passage(s) 23 may be arranged in only one position or three or more positions.

(Form of Communication Groove 21)

Referring to FIGS. 6 to 9, description will be made on the form of communication groove 21 as well as an air-flowing function of communication grooves 21 and communication passages 23.

Figure 6:
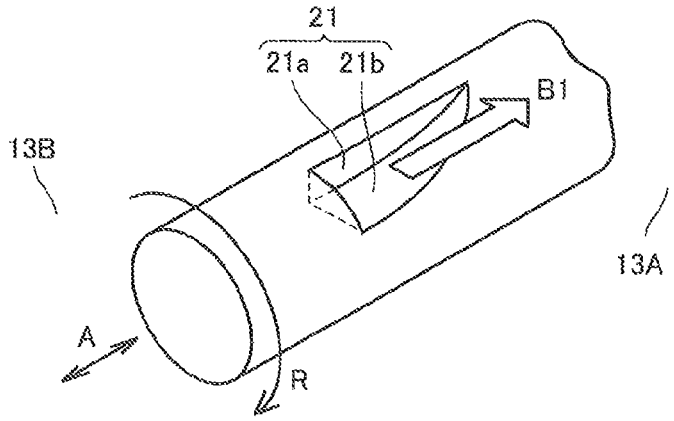
FIG. 6 is a fragmentary perspective view showing, on an enlarged scale, a structure of a communication groove arranged on the rotation shaft in the embodiment.
Figure 7:
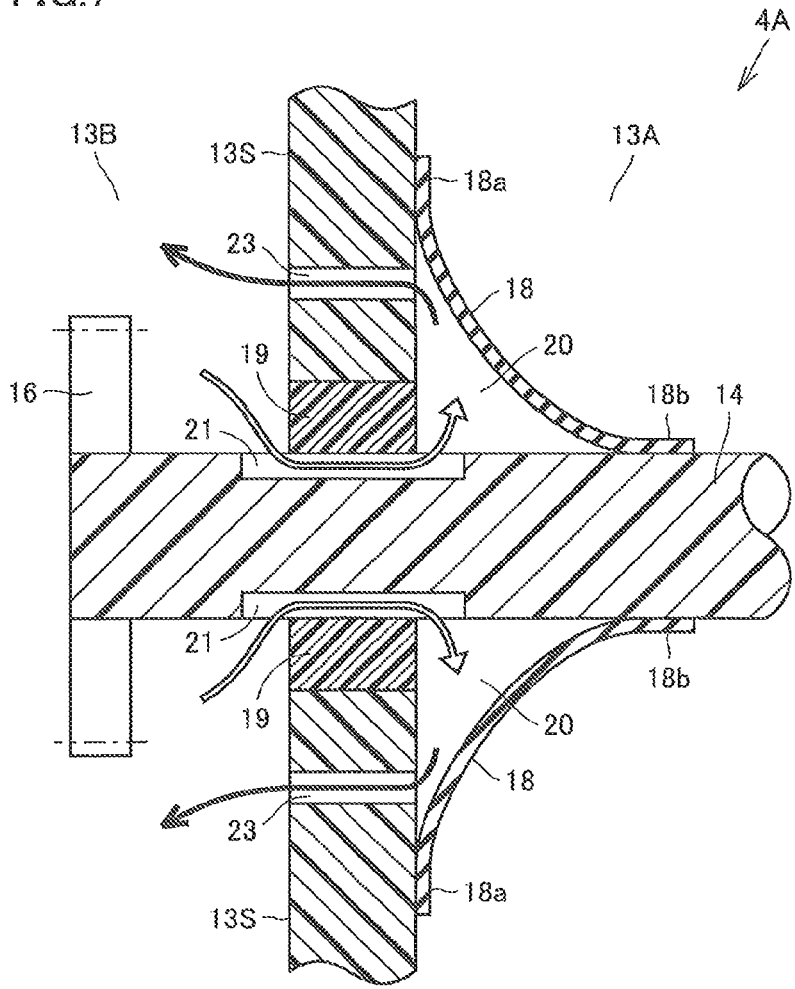
FIG. 7 is a schematic section showing an air flow caused by the communication groove shown in FIG. 6.

Referring first to FIGS. 6 and 7, communication groove 21 shown in FIG. 6 has a rising wall 21*a* on an upperstream (rear) side with respect to a rotation direction R of transportation screw shaft 14, and has a bottom surface 21*b* that increases a groove depth as the position moves from the side near outer space 13B toward inner space 13A. According to this groove form, when transportation screw shaft 14 rotates in rotation direction R, an air flow directed in the axial direction (A) from outer space 13B toward inner space 13A occurs on the surface of communication groove 21.

Consequently, as shown in FIG. 7, when transportation screw shaft 14 rotates, the air on the outer space 13B side flows through communication grooves 21 into closed space 20. Since closed space 20 enters the pressurized state, the air in closed space 20 flows through communication passages 23 into outer space 13B.

Figure 8:
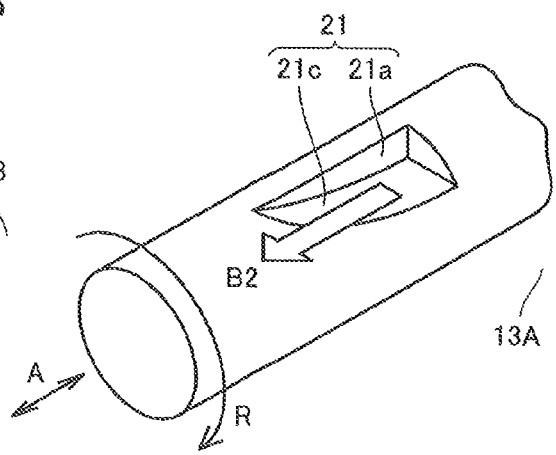
FIG. 8 is a fragmentary perspective view showing, on an enlarged scale, another structure of the communication groove arranged on the rotation shaft in the embodiment.
Figure 9:
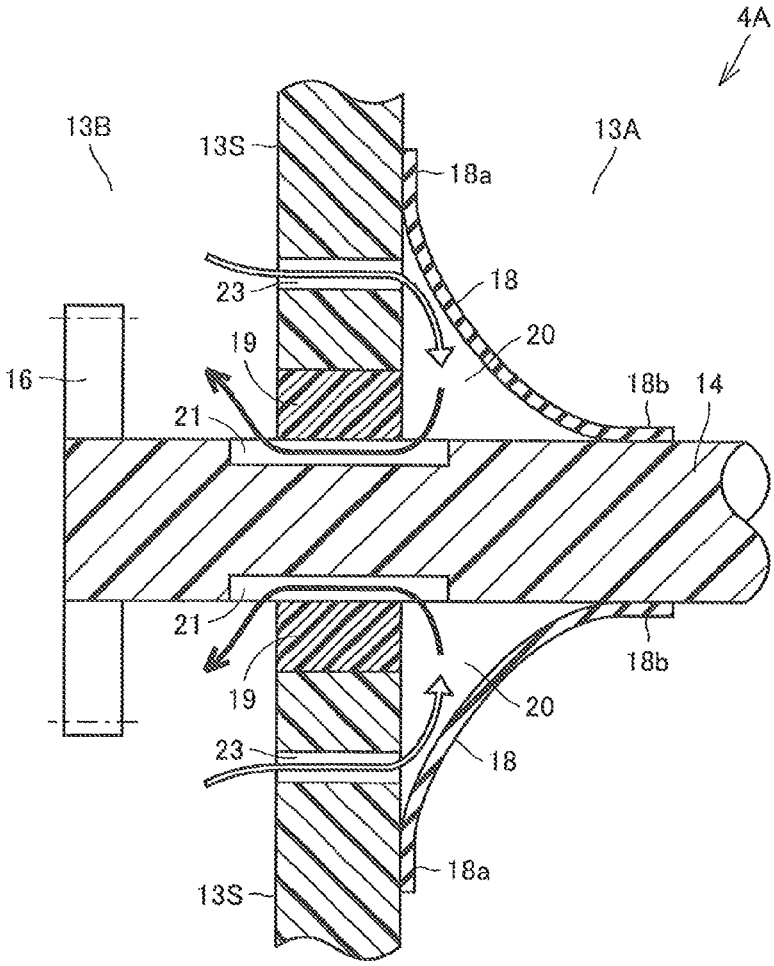
FIG. 9 is a schematic section showing the air flow caused by the communication groove shown in FIG. 8.

Referring to FIGS. 8 and 9, description will be made on communication groove 21 having another form as well as the air-flowing function between communication groove 21 and communication passage 23. Communication groove 21 shown in FIG. 8 has rising wall 21*a* on the upperstream (rear) side with respect to rotation direction R of transportation screw shaft 14, and has a bottom surface 21*c* that decreases the groove depth as the position moves from inner space 13A toward outer space 13B. According to this groove form, when transportation screw shaft 14 rotates in rotation direction R, an air flow directed in the axial direction (A) from inner space 13A toward outer space 13B occurs on the surface of communication groove 21.

Consequently, as shown in FIG. 9, when transportation screw shaft 14 rotates, the air on the inner space 13A side flows through communication grooves 21 from closed space 20 toward outer space 13B side. Since closed space 20 is in the depressurized state, the air flows through communication passages 23 from outer space 13B into closed space 20.

As shown in FIGS. 7 and 9, by causing the flow bringing the air from closed space 20 to the outside, the heat occurring between transportation screw shaft 14 and bearing 19 can be directly and externally discharged according to circulation of the air in outer space 13B. Consequently, the external air can be directly applied to the bearing portion between transportation screw shaft 14 and bearing 19 so that the bearing portion can be efficiently cooled.

This can avoid the occurrence of failures such as sealing failure of the sealing member caused by attaching of the developer melted on the bearing portion onto the sealing member, and rotation failure of transportation screw shaft 14 due to fixing of the developer onto the bearing portion.

The shaft sealing structure for arranging sealing member 18 is not modified, and another device structure for cooling is not added so that developer containing device 4A does not increase in size. Consequently, developing device 4 employing developer containing device 4A as well as image forming apparatus 1000 employing developing device 4 do not increase in size.

Further, the sealing failure in developer containing device 4A and the rotation failure of transportation screw shaft 14 are avoided so that the failure in image formation on recording medium 11 in image forming apparatus 1000 is avoided, which can improve the reliability of image forming apparatus 1000.

The groove form of communication groove 21 is not restricted to those shown in FIGS. 6 and 8. Any groove form can be employed provided that the rotation of transportation screw shaft 14 can cause an air flow in the axial direction (A) on the surface of communication groove 21. Other groove forms will be described later.

Figure 10:
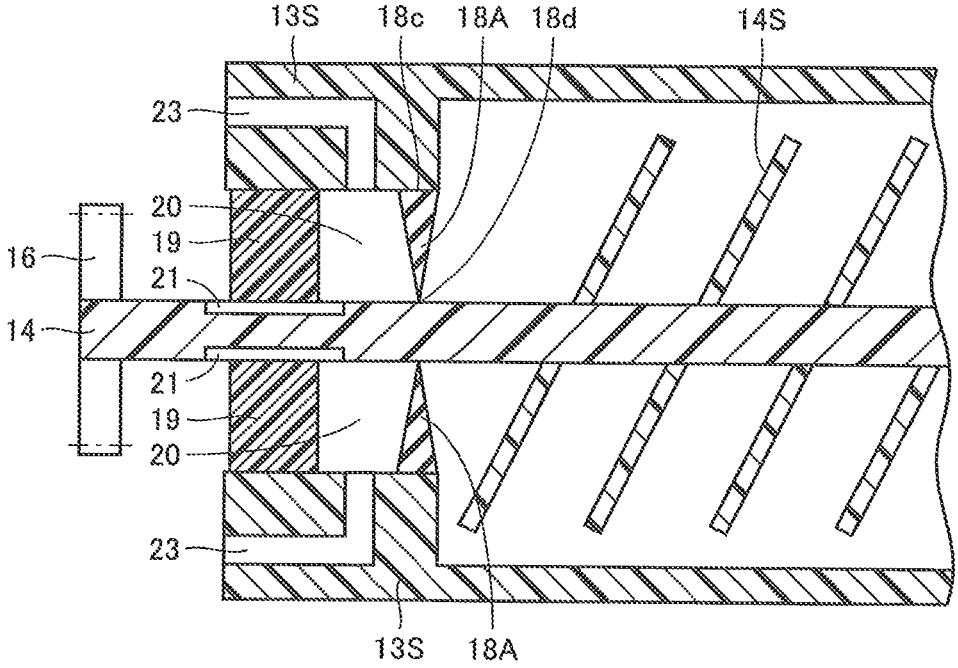
FIG. 10 is a fragmentary section showing, on an enlarged scale, a region containing a sealing member arranged on a partition in another form of the embodiment.
Figure 11:
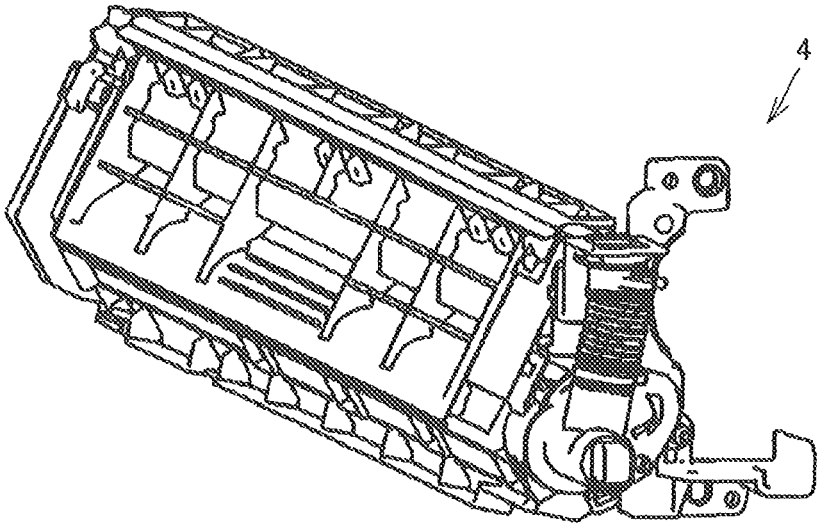
FIG. 11 is a perspective view showing an outer appearance of the developing device employing the developer containing device in a practical example.
Figure 12B:
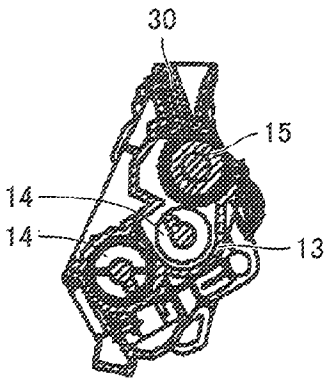
FIG. 12B is a side view showing the internal structure of the developing device employing the developer containing device in the practical example.
Figure 12A:
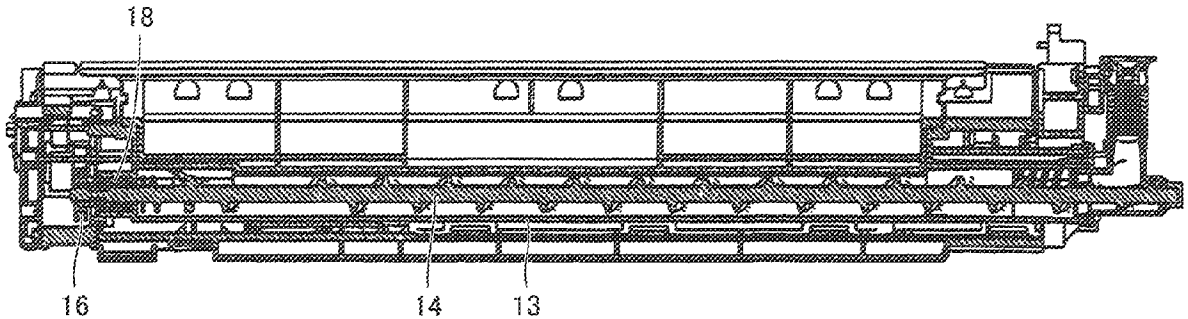
FIG. 12A is a plan showing an internal structure of the developing device employing the developer containing device in the practical example.

The embodiment has been described in connection with the structure that uses cylindrical sealing member 18 having a conical outer surface, but this structure is not restrictive. For example, as shown in a section of FIG. 10, the shaft sealing structure may be configured by employing a sealing member 18A of an annular form, fixing its outer periphery 18*c* to partition 13S and arranging its inner peripheral surface 18*d* around transportation screw shaft 14. Sealing member 18A is made of rubber, elastomer resin or the like. FIG. 10 is a fragmentary section showing, on an enlarged scale, a region containing sealing member 18A arranged on partition 13S in another form of the embodiment.

PRACTICAL EXAMPLES

Specific and practical examples of developing device 4 will be described below with reference to FIGS. 11 to 14.

Portions that are the same as or correspond to those in developing device 4 in the foregoing embodiment bear the same reference numbers, and description thereof is not repeated. The basic structure is the same as that of the shaft sealing structure shown in FIG. 10.

Figure 13A:
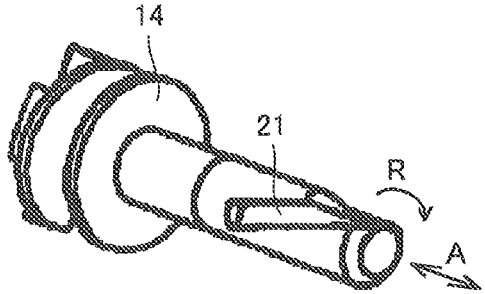
FIGS. 13A and 13B are perspective views showing forms of the communication grooves in the practical example.
Figure 13B:
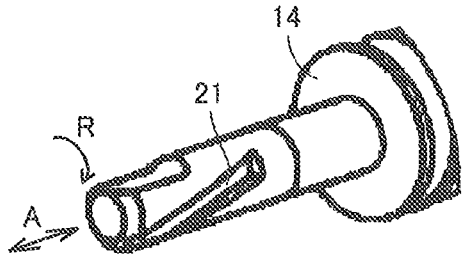

As shown in FIGS. 13A and 13B, transportation screw shaft 14 is provided at its one end portion with two communication grooves 21. Communication grooves 21 in this practical example have the same groove form, and each are inclined leftward by about 15 degrees with respect to the axial direction (A) of transportation screw shaft 14.

Communication passages 23 are arranged at four positions of partition 13S, respectively, and are circumferentially spaced by 90 degrees from each other around transportation screw shaft 14. When transportation screw shaft 14 rotates in rotation direction R, the air flows on the surface of communication groove 21 in the axial direction (A) from the outer space side toward the inner space side.

Figure 14:
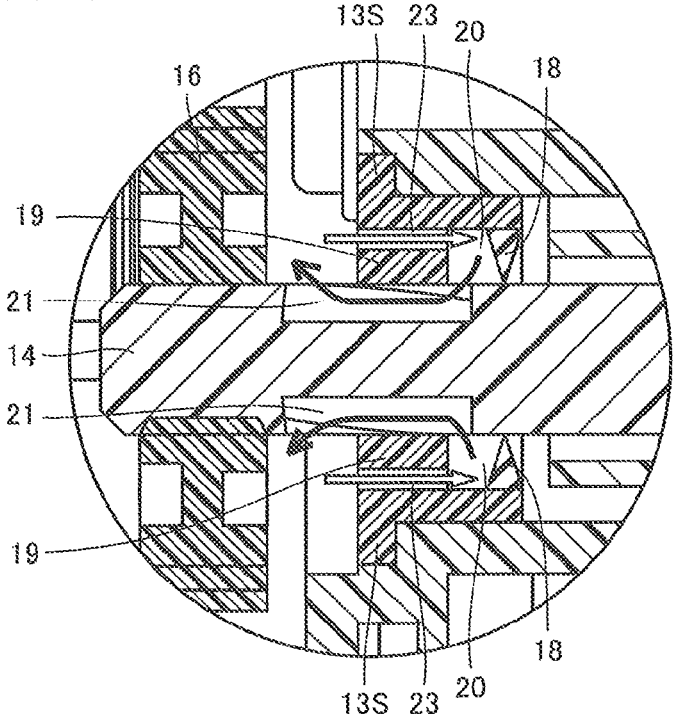
FIG. 14 is a fragmentary section showing, on an enlarged scale, a region containing the sealing member arranged on the partition in the practical example.

Consequently, as shown in FIG. 14, when transportation screw shaft 14 rotates, the air flows from the outer space side through communication grooves 21 toward closed space 20. Since closed space 20 attains a pressurized state, the air in closed space 20 flows through communication passages 23 to outer space 13B.

When the rotation speed of transportation screw shaft 14 was 600 rpm (in rotation direction R in FIGS. 13A and 13B), measurement was conducted to obtain a temperature in closed space 20 of a conventional structure not having communication groove 21 and communication passage 23 as well as a temperature in closed space 20 of the structure of the this practical example having communication grooves 21 and communication passages 23. A J-type thermocouple was used for measuring the temperature in closed space 20. Results are as follows. The temperature rising in closed space 20 of the conventional structure was about 35.0 degrees, and the temperature rising in closed space 20 of the practical example was about 25.0 degrees.

As described above, the flow occurs to flow externally the air from closed space 20. The heat occurring between transportation screw shaft 14 and bearing 19 can be directly and externally discharged by circulating the air in the outer space as described above. Consequently, the external air can be directly applied to the bearing portion between transportation screw shaft 14 and bearing 19, and the bearing portion can be efficiently cooled.

Thereby, it is possible to avoid occurrence of failures such as the sealing failure of the sealing member caused by melting of the developer in the bearing portion and subsequent adhesion of such developer to the sealing member, and the rotation failure of transportation screw shaft 14 due to fixing of the developer to the bearing portion.

Figure 15A:
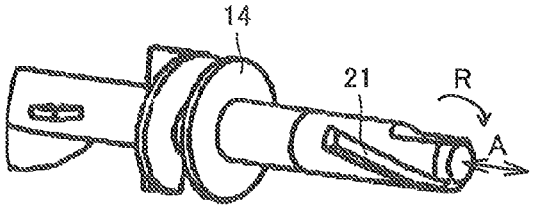
FIGS. 15A and 15B are perspective views showing another form of the communication groove in the practical example.
Figure 15B:
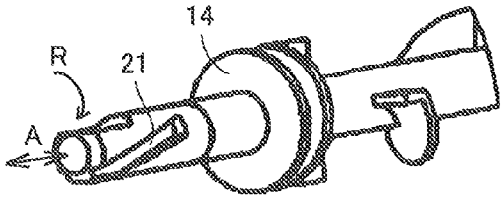

Two communication grooves 21 in this practical example have the same groove form, and are inclined in the same direction by about 15 degrees with respect to the axial direction (A) of transportation screw shaft 14. However, communication grooves 21 may have the groove forms shown in FIGS. 15A and 15B. These communication grooves 21 are inclined with respect to the axial direction (A), and particularly are inclined symmetrically with respect to line in the axial direction (A).

Figure 16:
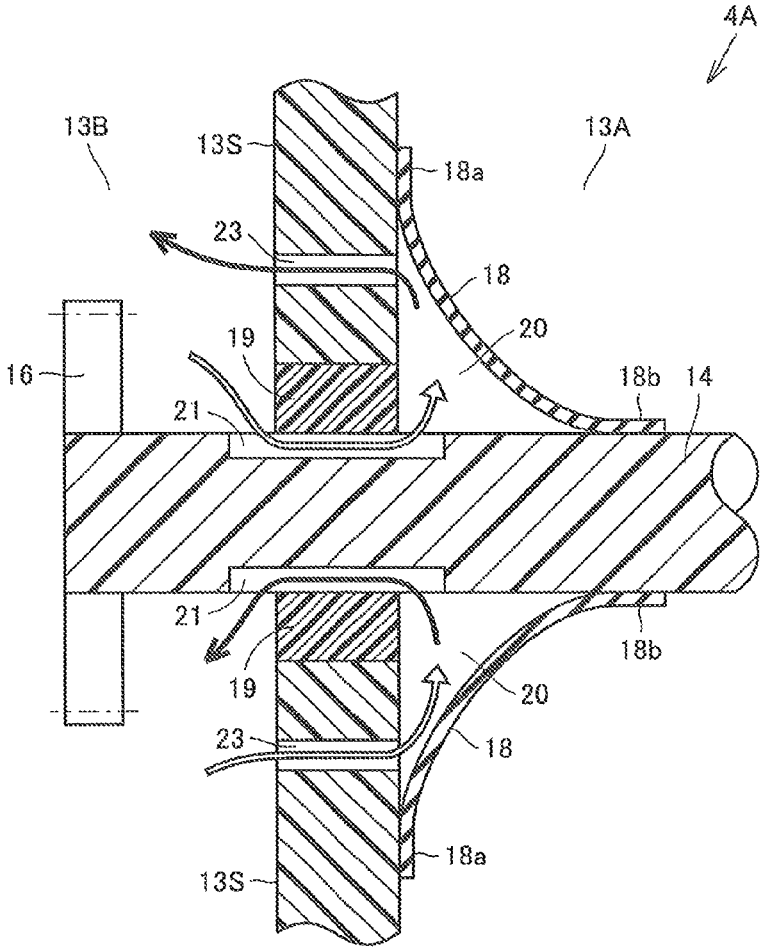
FIG. 16 is a schematic section showing an air flow caused by the communication grooves shown in FIGS. 15A and 15B.

When this structure is employed, e.g., in the axial sealing structure of the embodiment shown in FIG. 4, transportation screw shaft 14 rotates as shown in FIG. 16, the air in one of communication grooves 21 flows on its surface in the axial direction (A) from the outer space side toward the inner space side, and the air in the other communication groove 21 flows on its surface in the axial direction (A) from the inner space side toward the outer space side. Consequently, it is possible to disturb the air flow in closed space 20, and thereby to expect improvement of the cooling effect in closed space 20.

Figure 17:
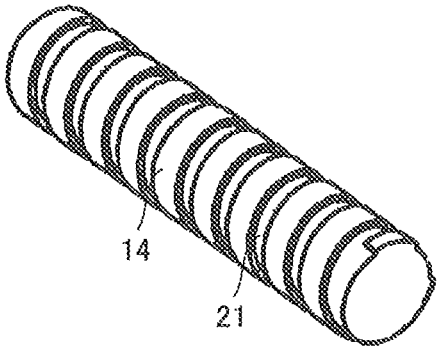
FIG. 17 is a perspective view showing still another form of the communication groove in the practical example.
Figure 18:
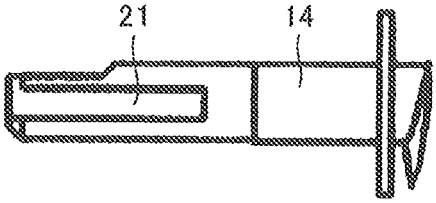
FIG. 18 is a perspective view showing further another form of the communication groove in the practical example.

As the groove structures of transportation screw shaft 14 other than the above, it is possible to employ communication groove 21 of a spiral form as shown in FIG. 17 or communication groove 21 of a linear form in the axial direction as shown in FIG. 18.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A developer containing device for containing a developer, comprising:

a partition located between an outer space and an inner space for containing said developer;

a bearing arranged on said partition;

a rotation shaft carried by said bearing and extending from said outer space into said inner space;

a sealing member arranged on an inner space side of said partition for isolating said bearing from said inner space by fixing one end side of said sealing member to said partition and keeping the other end side of said sealing member in contact with a surface of said rotation shaft, said sealing member being spaced apart from said bearing so that said sealing member forms a closed space between said bearing and said sealing member;

a communication groove arranged at the surface of said rotation shaft for connecting said outer space to said closed space;

a communication passage arranged in said partition for connecting said outer space to said closed space; and wherein said communication groove and said communication passage form a path configured to circulate air between said outer space and said closed space so that air flows through said communication groove and said communication passage in opposite directions.

2. The developer containing device according to claim 1, wherein said communication groove has a groove form causing an air flow in an axial direction on a surface of said communication groove according to rotation of said rotation shaft.

3. The developer containing device according to claim 2, wherein said communication groove is inclined with respect to the axial direction of said rotation shaft.

4. The developer containing device according to claim 3, wherein said communication groove has first and second grooves at the shaft surface opposed to said bearing, said first and second grooves are inclined with respect to said axial direction, and the respective inclination directions of said first and second grooves are symmetrical with respect to line in said axial direction.

5. The developer containing device according to claim 1, wherein said partition is an outer wall of said developer containing device.

6. The developer containing device according to claim 1, wherein said rotation shaft is a transportation screw shaft provided with a developer transportation screw of said developer containing device.

7. An image forming apparatus comprising a developer containing device for containing a developer, wherein said developer containing device includes:

a partition located between an outer space and an inner space for containing said developer;

a bearing arranged on said partition; a rotation shaft carried by said bearing and extending from said outer space into said inner space;

a sealing member arranged on an inner space side of said partition for isolating said bearing from said inner space by fixing one end side of said sealing member to said partition and keeping the other end side of said sealing member in contact with a surface of said rotation shaft, said sealing member being spaced apart from said bearing so that said sealing member forms a closed space between said bearing and said sealing member;

a communication groove arranged at the surface of said rotation shaft for connecting said outer space to said closed space;

a communication passage arranged in said partition for connecting said outer space to said closed space; and wherein said communication groove and said communication passage form a path configured to circulate air between said outer space and said closed space so that air flows through said communication groove and said communication passage in opposite directions.

8. The image forming apparatus according to claim 7, wherein said communication groove has a groove form causing an air flow in an axial direction on a surface of said communication groove according to rotation of said rotation shaft.

9. The image forming apparatus according to claim 8, wherein said communication groove is inclined with respect to the axial direction of said rotation shaft.

10. The image forming apparatus according to claim 9, wherein said communication groove has first and second grooves at the shaft surface opposed to said bearing, said first and second grooves are inclined with respect to said axial direction, and the respective inclination directions of said first and second grooves are symmetrical with respect to line in said axial direction.

11. The image forming apparatus according to claim 7, wherein said partition is an outer wall of said developer containing device.

12. The image forming apparatus according to claim 7, wherein said rotation shaft is a transportation screw shaft provided with a developer transportation screw of said developer containing device.

13. A device for housing developer comprising:

a partition positioned between an exterior space and an interior space configured to house the developer;

a rotatable shaft extending through the partition between the exterior space and the interior space;

a bearing surrounding a portion of the rotatable shaft extending through the partition and configured to rotatably support the rotatable shaft;

a sealing member fixed to a surface of the partition facing the interior space and sealingly engaged with a portion of the rotatable shaft inside the inner space, the sealing member being configured to shield the bearing from developer housed in the interior space, wherein a portion of the sealing member is spaced apart from the rotatable shaft and the partition to form a cooling gap between the partition, the rotatable shaft and the sealing member;

a through hole extending through the partition and providing a path for air to flow between the exterior space and the cooling gap;

a groove formed in the portion of the rotatable shaft surrounded by the bearing, the groove being configured to circulate air between the exterior space and the cooling gap during rotation of the rotatable shaft so that air flows through the groove and the through hole in opposite directions.

14. The device of claim 13, wherein the groove is angled relative to a rotational axis of the rotatable shaft.

* * * * *